United States Patent [19]

Ishioka

[11] Patent Number: 5,063,657

[45] Date of Patent: Nov. 12, 1991

[54] APPARATUS FOR LOADING MULTICONDUCTOR CABLE ON CONNECTOR HALF

[75] Inventor: Hideyuki Ishioka, Tokyo, Japan

[73] Assignee: Hirose Electric Co., Ltd., Tokyo, Japan

[21] Appl. No.: 646,219

[22] Filed: Jan. 28, 1991

[51] Int. Cl.[5] ..... H01R 43/04

[52] U.S. Cl. ..... 29/753; 29/759

[58] Field of Search ..... 29/749, 751, 753, 748, 29/759

[56] References Cited

U.S. PATENT DOCUMENTS 4,470,181 9/1984 Sergeant ..... 29/33 M 4,888,864 12/1989 Masaki ..... 29/753

*Primary Examiner*—Carl E. Hall

*Attorney, Agent, or Firm*—Kanesaka & Takeuchi

[57] ABSTRACT

Apparatus for loading respective conductors of a multiconductor cable on corresponding retention channels of a connector half, which includes a connector holder 3, 4 for holding a connector half C1, C2; a conductor guide 1A, 2A provided beside each connector holder; a cable holder 7 movable in a direction perpendicular to the connector holder for holding the multiconductor cable P beside the connector holder; a receiver unit 8 having a receiver slot 9 for receiving the respective conductors one upon another; a transfer unit 11 movable on the receiver unit in a direction perpendicular to the receiver slot and having a transfer channel parallel to the receiver slot for receiving an uppermost conductor; a conductor receiving unit having a receiver channel 14 for receiving the uppermost conductor when the transfer unit is in an advanced position and an escapement slot 15 extending in a direction perpendicular to the receiver slot; a cable stabilizer 11A interlocked to the transfer unit and having a front edge substantially flash with the conductor receiver slot when the transfer unit is in the advanced position; and a carrier unit 20 having a pair of grippers 24, 25 for bringing the uppermost conductor from the receiver unit to the connector holder; and a conductor pusher 26 provided beside the fixed gripper for pushing the uppermost conductor into a retention channel of the connector half at the identified position.

2 Claims, 4 Drawing Sheets

| FIG. 3A | FIG. 3B |
|---|---|

APPARATUS FOR LOADING MULTICONDUCTOR CABLE ON CONNECTOR HALF

BACKGROUND OF THE INVENTION

1. Field of the Invention

The present invention relates to apparatus for loading a multiconductor cable on a connector half and, more particularly, to apparatus for loading respective conductors of a multiconductor cable into corresponding retention channels of a connector half for connection by insulation displacement, for example.

2. Description of the Prior Art

Japanese Patent Application Kokai No. 57-182,988 discloses a machine of this type. This machine includes a pair of longitudinal rollers spaced apart at the distance of a conductor diameter between which a number of conductors are aligned side by side; a ram for pushing the conductors out of the rollers one by one; and a disc with a notch provided at the lower ends of the longitudinal rollers so that one conductor is moved for each rotation of the disc.

A pair of lateral rollers are provided below the longitudinal rollers to hold a conductor between them applying tension to it. A transfer arm with a V-shaped notch is provided so as to reciprocate through a arcked slot provided on the disc. A connector is placed at a position adjacent the front of the transfer arm and is moved by pitch, with a multiconductor cable held in the vicinity.

In the above machine, when the notch of the disc corresponds to the lower ends of the rollers, one conductor is received in the notch and moved by a half circle by rotation of the disc. The front end of the conductor is then held between the lateral rollers and pulled downwardly for stretching in the diametrical direction of the disc. When the transfer arm is advanced through the arcked slot of the disc, the V-shaped notch brings the conductor to the desired position. The conductor is then inserted into the desired retention groove of the connector by an insertion device which is provided beside the connector. In response to the conductor identification signal, the connector is moved so that the desired retention groove is positioned below the insertion device.

In the above machine, however, the conductor is transferred to the lateral rollers from the disc by making use of the hanging end portion of the conductor. Consequently, when the conductor has a short hanging portion or bent portion, the lateral rollers can fail to catch it, which in turn causes the transfer arm to fail to bring the conductor to the desired position. In addition, even when the lateral rollers catch the hanging portion, the transfer arm can fail to bring the conductor to the desired position.

Since the multiconductor cable is held along the longitudinal direction of the connector, it is impossible to position the cable at the center of the connector but either end of the connector, requiring a special connector case.

SUMMARY OF THE INVENTION

Accordingly, it is an object of the present invention to provide an apparatus for loading a multiconductor cable on a connector half which is reliable and accurate in positioning of individual conductors.

According to an embodiment of the invention the above object is accomplished by apparatus for loading respective conductors of a multiconductor cable on corresponding retention channels of a connector half, which includes (a) a connector holder for holding a connector half so that retention channels of the connector half are exposed; (b) a conductor guide provided beside the connector holder and having guide slits at positions which corresponds to the retention channels of the connector half; (c) a cable holder movable in a direction perpendicular to the connector holder for holding the multiconductor cable beside the connector holder; (d) a receiver unit for receiving the respective conductors one upon another, the receiver unit having: a receiver slot extending downwardly from a top surface of the receiver unit and having a width substantially equal to a diameter of the respective conductors for receiving the respective conductors one upon another; and a biasing member provided at a bottom of the receiver slot for biasing upwardly the respective conductors within the receiver slot; (e) a transfer unit movable on the receiver unit in a direction perpendicular to the receiver slot and having a transfer channel parallel to the receiver slot for receiving an uppermost conductor; (f) a conductor receiving unit for receiving the uppermost conductor when the transfer unit is in an advanced position, the conductor receiving unit including: a receiver channel extending in parallel to the receiver slot on the receiver unit for receiving the uppermost conductor when the transfer unit is in the advanced position; and an escapement slot extending in a direction perpendicular to the receiver slot and having a depth greater than the diameter of the respective conductors; (g) a cable stabilizer interlocked to the transfer unit and having a front edge substantially flash with the conductor receiver slot when the transfer unit is in the advanced position; and (h) a carrier unit for bringing the uppermost conductor from the receiver unit to the connector holder, the carrier unit including: a carrier arm with an end portion pivoted to the carrier unit; a pair of grippers; one fixed at the end portion of the carrier arm and the other movable along the carrier arm and gripping the uppermost conductor and contacting with a wire of the uppermost conductor for identifying a position of the uppermost conductor on the connector half when the transfer unit is in the advanced position; and a conductor pusher provided beside the fixed gripper for pushing the uppermost conductor into a retention channel of the connector half at the identified position.

According to the invention, a multiconductor cable is loaded on a connector half as follows:

(1) Respective conductors of a multiconductor cable are separated, with the multiconductor cable held with a cable holer. The respective conductors are aligned in the receiver slot one upon another. The uppermost conductor is covered with the transfer block and the conductor stabilizer so that it does not fall out of the receiver slot.

(2) The uppermost conductor is pushed upwardly into the transfer channel of the transfer block by the pusher strip. Then, the uppermost conductor is brought to the receiver slot as the transfer block is advanced.

(3) The movable gripper is brought to the fixed gripper, and the carrier unit is moved downwardly so that the grippers hold the uppermost conductor within the escapement slot.

(4) The movable gripper comes into contact with a wire of the uppermost conductor for identifying the wire number. The grippers are brought to a position corresponding to the retention channel of the connector half which has been identified with the wire number.

(5) During movement from the escapement slot to the above identified position, the grippers are spaced apart so as to apply tension to the uppermost conductor. When the uppermost conductor is taken out of the escapement slot by the gripper, the other conductors are suppressed by the conductor stabilizer so that the next conductor is prevented from coming together with the uppermost conductor.

(6) Then, the uppermost conductor brought to the desired retention channel by the carrier unit is pushed into the retention channel of the connector half by the pusher strip. In this way, the respective conductors are pushed into the corresponding retention channels, thereby completing loading the multiconductor cable on the connector half.

The above and other objects of the invention will be more apparent from the following description when taken in conjunction with the accompanying drawings.

DESCRIPTION OF THE PREFERRED EMBODIMENT

Figure 1:
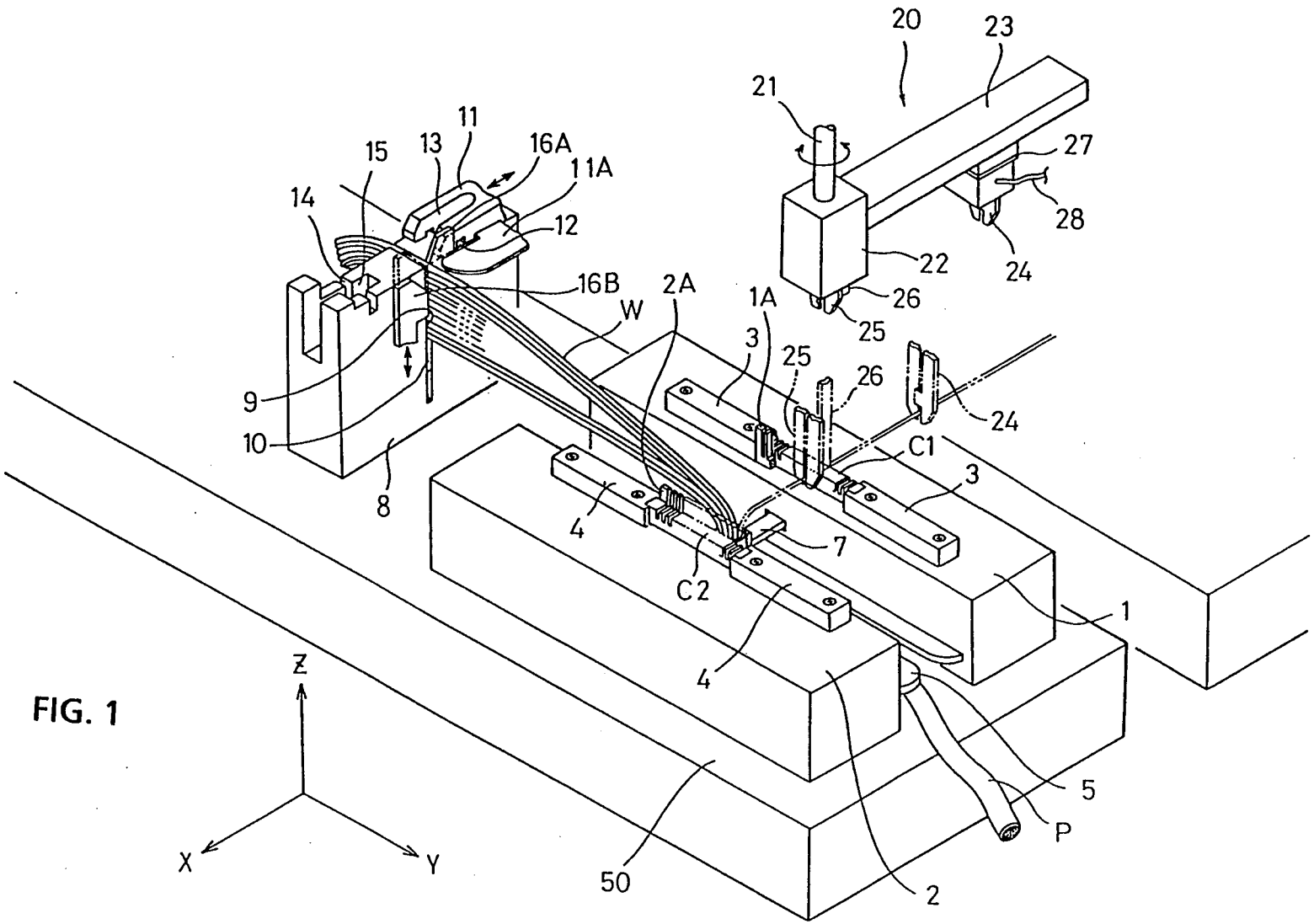
FIG. 1 is a perspective view of apparatus for loading a multiconductor cable on a connector half according to an embodiment of the invention.

FIG. 1 shows a machine for loading a multiconductor cable on a connector half according to an embodiment of the invention. In order to set directions, coordinates X, Y, and Z are provided in the figure. A pair of base sections 1 and 2 are spaced in the X direction on a movable base 50 which is movable in the Y direction. A pair of elongated connector holders 3 and 4 are mounted on the base sections 1 and 2, respectively, in the Y direction. Alternatively, the base sections 1 and 2 may be mounted on a fixed base. A pair of holder sections of each connector holder 3 or 4 are replaceable with other ones and movable in the Y direction so as to accommodate a variety of types and sizes of connector halves. A guide plate 5 with a U-shaped recess for guiding a multiconductor cable P is provided between opposed faces of the base sections 3 and 4. A cable holder 7 is movable in the X direction to hold the cable P at the bottom position of the U-shaped recess.

A pair of conductor guides 1A and 2A are mounted on the base sections 1 and 2, respectively, so that the guiding slits of each conductor guide 1A or 2A correspond to the retention channels of a connector half C1 or C2.

A receiver block 8 is mounted on the movable base 50 behind the base sections 1 and 2. The receiver block 8 has in the center a receiver slot 9 extending in the Y direction and downwardly from the top surface of the receiver block 8 for receiving respective conductors of the cable P. The width of the receiver slot 9 in the X direction is set substantially equal to the diameter of a conductor. A biasing plate 10 is provided at the bottom of the receiver slot 9 and biased upwardly in the Z direction by a compression spring or the like (not shown).

A transfer block 11 is provided on the right side of the receiver slot 9 for sliding movement on the top surface of the receiver block 8. This transfer block 11 has a U-shaped recess 13 and a transfer channel 12 extending in the Y direction on the bottom surface so as to receive a single conductor of the cable P.

A conductor stabilizer 11A extends laterally from the bottom of the transfer block 11 and has a curved front edge which is substantially flash with the front end of the transfer block 11.

A receiver channel 14 is provided on the left side of the receiver slot 9 extending in the Y direction. The receiver channel 14 registers with the transfer channel 12 when the transfer block 11 is in the advanced position. An escapement slot 15 is provided on the receiver block 8 extending in the X direction at right angles with the receiver channel 14. The depth of the escapement slot 15 is greater than that of the receiver channel 14. The receiver channel 14 and the escapement slot 15 constitute a conductor receiving unit.

A pair of guide plates 16A and 16B are provided on opposite sides of the receiver slot 9. The opposed upper corners of the guide plates 16A and 16B are cut into the V-shape for facilitating insertion of conductors into the receiver slot 9. The guide plate 16A is fixed so that the top end projects from the receiver block 8, while the other guide plate 16B is made movable so that it is able to move downwardly below the top surface of the receiver block 8; it is interlocked with the transfer block 11 by an interlocking mechanism (not shown) so that it is in the retreated position when the transfer block 11 is in the advanced position on the left side of the receiver slot 9 while it is in the advanced projecting position when the transfer block 11 is in the retreated position on the right side of the receiver slot 9.

A conductor carrier 20 is provided above the movable base 50 so as to be rotatable about a shaft 21 by a given angle (90 degrees in this embodiment) and movable in each X, Y, or Z direction by a distance instructed. This distance is determined by a control unit based on the line number identified by a connection detector to be described later.

A carrier arm 22 extends laterally from a carrier body 22 of the conductor carrier 20. A pair of grippers 24 and 25 extend downwardly from the carrier body 22 and the carrier arm 22 for gripping a conductor between the finger members. A pusher strip 26 is provided beside the grip 25 so as to be movable upwardly and downwardly.

Figure 2:
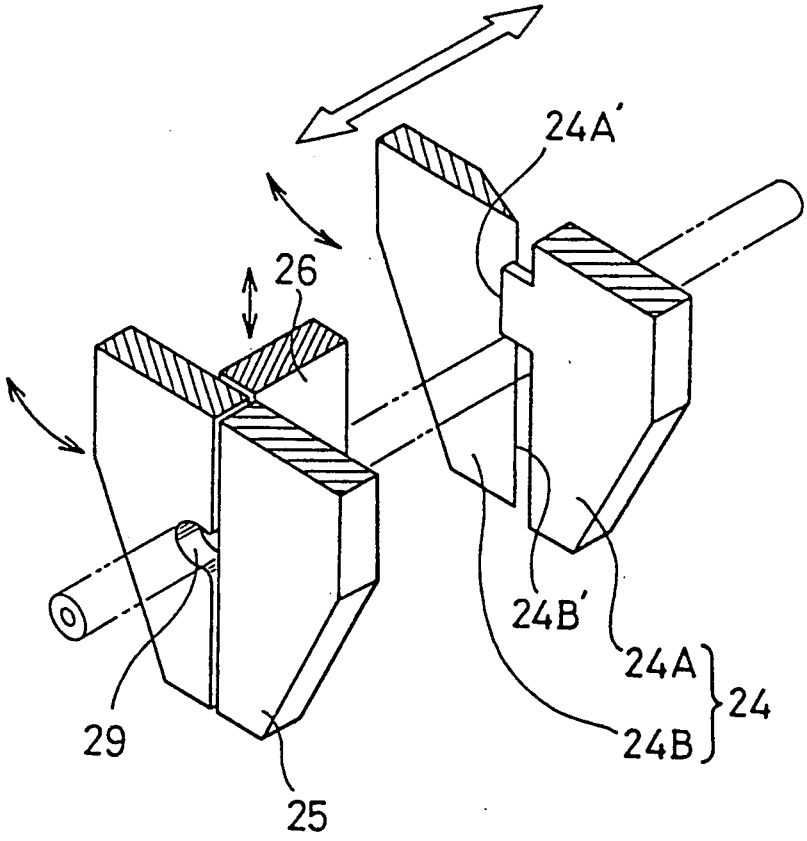
FIG. 2 is a perspective view of a pair of grippers useful for the apparatus of FIG. 1.

As FIG. 2 shows, the gripper 24 has a fixed finger 24A and a rotatable finger 24B. The fixed finger 24A has a projection 24A' for positioning a conductor, while the rotatable finger 24B has a blade 24B'. The blade 24B' cuts the insulation of a conductor into contact with a wire, constituting part of the connection detector. As FIG. 1 shows, the gripper 24 is insulated from the carrier arm 23 with an insulating material 27 and connected to the connection detector (not shown) via a line 28. When the gripper 24 comes into contact with the wire of an insulated conductor, the detector identifies the number of the conductor. A finger of the other gripper 25 has a semicircular notch for slidably holding an insulated conductor. The gripper 24 is movable along the carrier arm 23 so as to change the distance to the other gripper 25.

Insulated conductors of a multiconductor cable are loaded into corresponding retention channels of a connector half as follows:

(1) A predetermined length of a sheath at each end of a multiconductor cable P is removed to separate respective insulated conductors W. The multiconductor cable P is held in place with the cable holder 7, and the respective insulated conductors W are inserted into the receiver slot 9. At this point, the transfer block 11 is placed in the retreated position, and the guide plate 16B is placed in the advanced projecting position to form a V-shape opening with the guide plate 16A. When all of the conductors are placed into the receiver slot 9, the transfer block 11 is advanced so that the transfer channel 12 registers with the receiver slot 9.

(2) The biasing plate 10 is pushed upwardly by a compression spring or the like so that the top conductor is placed into the transfer channel 12. Then, the transfer block 11 is advanced so that the transfer channel 12 registers with the receiver slot 14. At this point, the conductor stabilizer 11A is placed on the top conductor within the receiver slot 9.

(3) The grippers 24 and 25, which have been in the standby position above the transfer block 11, are moved downwardly into the escapement slot 15 to grip the conductor. At the same time, the blade 24B' of the finger member 24 comes into contact with the wire of the conductor so that the conductor number is identified. Then, the transfer block 11 is retreated to permit the grippers 24 and 25 to take the conductor out of the escapement slot 15.

(4) The grippers 24 and 25 are moved upwardly to take the conductor out of the escapement slot 15. At this point, the top conductor emerges from the receiver slot 9 dodging around the curved front edge of the conductor stabilizer 11A, which prevents the second and subsequent conductors from emerging from the receiver slot 9. Then, the grippers 24 and 25 are spaced apart from each other to apply tension to the conductor and moved to the retention channel of a connector half C1 or C2 so that they are placed beside the conductor guide 1A and the connector C1. Then, the pusher strip 26 is moved downwardly until it abuts on the top surface of the conductor. The above movement is controlled by the control unit based on the conductor number identified with the blade 24B'.

(5) The grippers 24 and 25 are moved downwardly by a predetermined distance so that the conductor is inserted into a identified slit of the conductor guide 1A. The pusher strip 26 pushes the conductor into the retention channel of the connector half C1, thus completing loading of a single conductor on the connector.

(6) The above process is repeated for the remaining conductors. When all of the conductors are loaded W on the connector half, the connector half is joined with another connector half (not shown) which has a number of contacts therein, thereby providing a connector unit wherein the respective contacts are connected to the conductors.

(7) While a multiconductor cable is loaded on a connector half on a movable base 50 by the above process (1) through (6), another cable is prepared for loading on another connector half on the adjacent movable base 50.

(8) The other end of the cable is loaded on another connector half by repeating the above process, thus providing a multiconductor cable with each end terminated with a connector. The respective conductors are provided with a straight portion by the conductor guide 1A so that it is easy to handle the connector half in subsequent operations.

Although two connector halves are shown in the above embodiment, one or three or more connector halves may be used. The directions in which connector halves and conductors are held may be changed depending on the requirements for the machine.

While the conductors are pushed into the retention channels of a connector half in the above embodiment, the conductors may be directly connected to contacts of a connector half by insulation replacement, for instance.

Figure 3A:
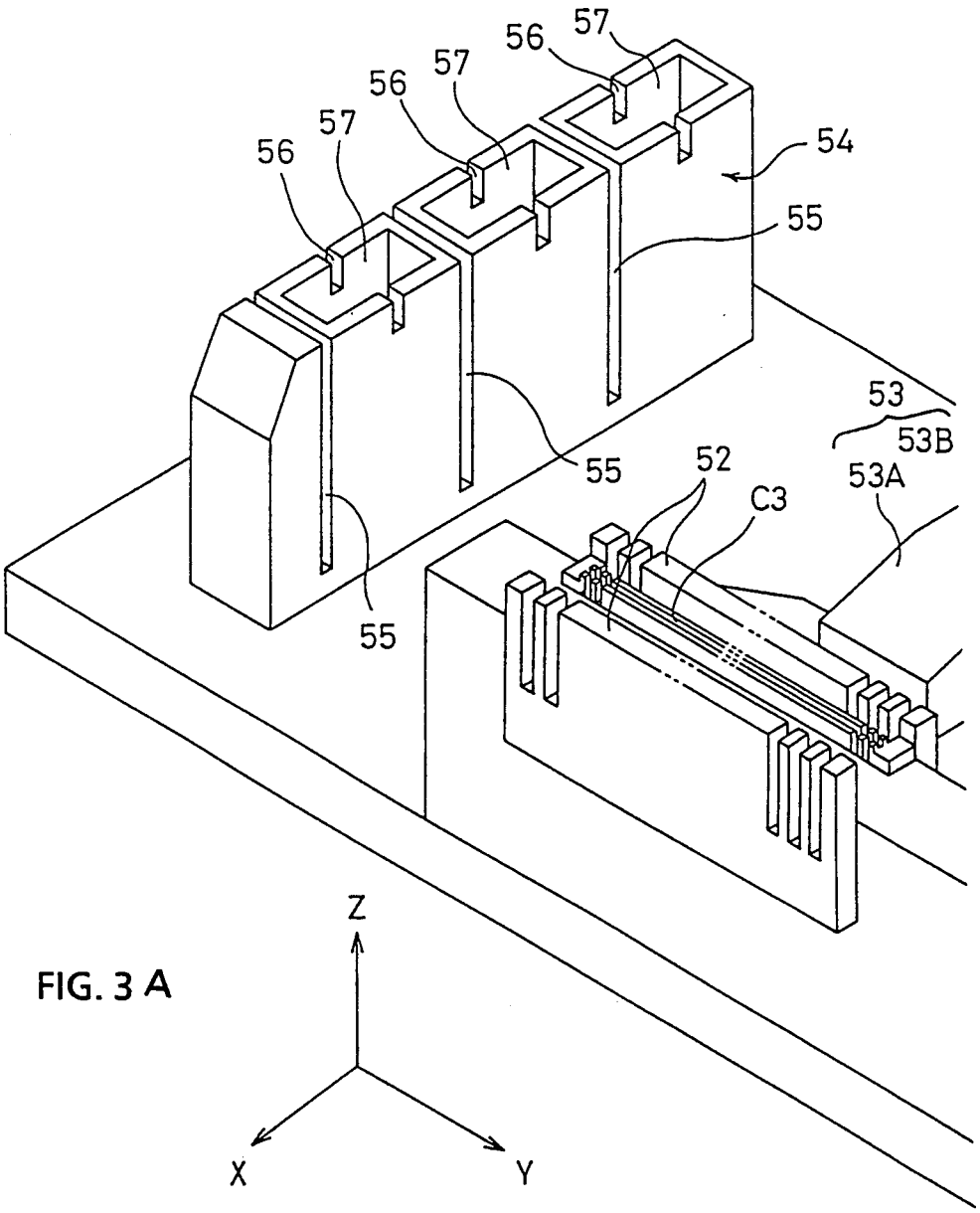
FIG. 3 is a perspective view of apparatus for loading a multiconductor cable on a connector half according to another embodiment of the invention.
Figures 3, 3B:
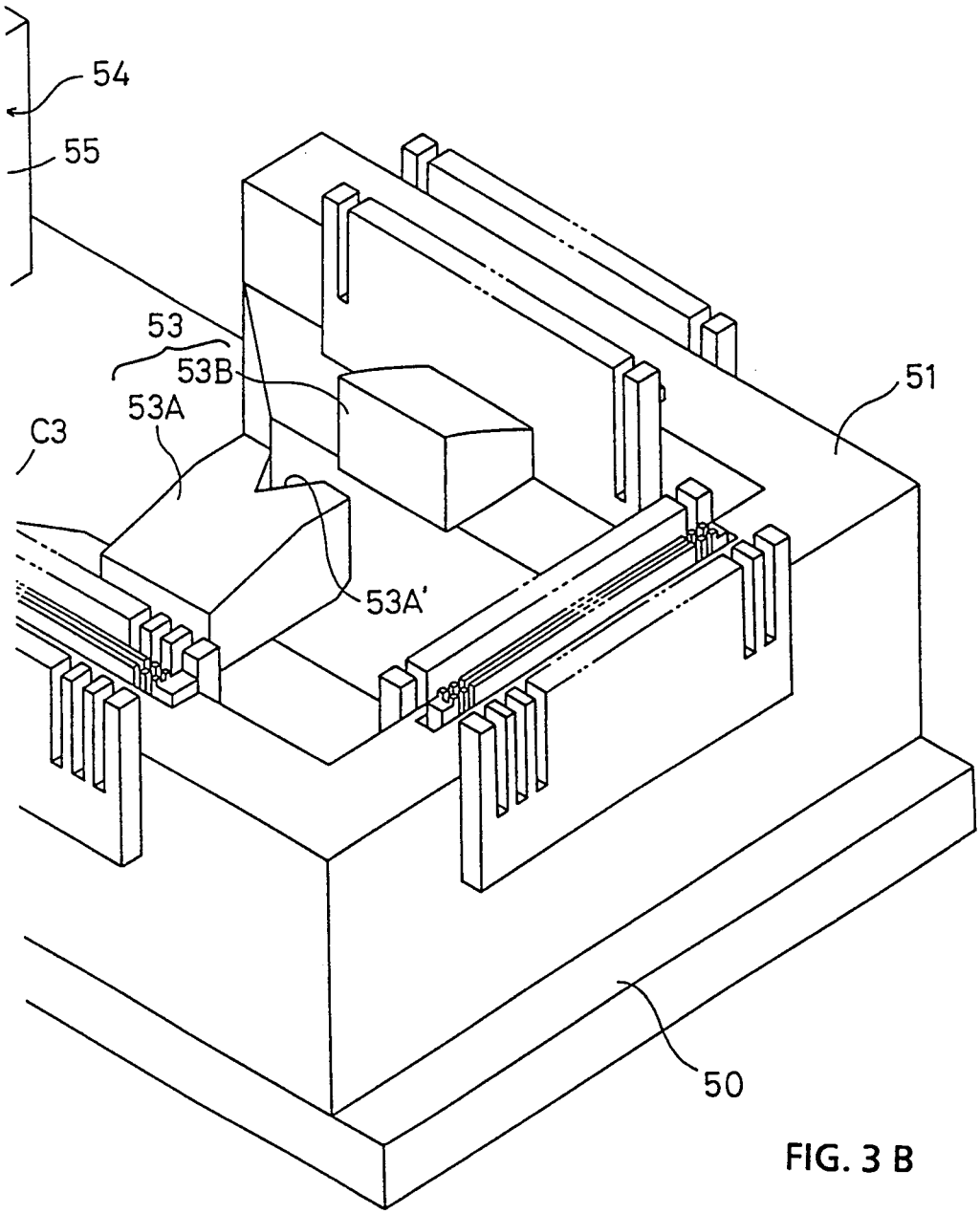

FIG. 3 shows apparatus for loading a multiconductor cable on a connector half. In this embodiment, the movable base 50 is movable not only in the Y direction as the above embodiment but also out of the case.

A substantially C-shaped base section 51 is mounted on the movable base 50. It is possible to set a connector half C3 on each side of the base section 51 (in this figure, two connector halves are shown). Although the connector holders are provided on the base sections in the above embodiment, there are provided a holding groove on each side of the base section 51 for receiving a connector half C3 therein. Alternatively, connector holders may be employed as the above embodiment.

A pair of conductor guides 52 are provided opposite sides of each side of the base section 51 such that the guiding slits of each conductor guide correspond to retention channels of a connector half. It is noted that unlike the above embodiment, the conductor guides 52 are provided on opposite sides of each side of the base section 51 and a connector half C3.

A cable holder 53 provided in the center of the C-shaped base section 51 has a pair of holding blocks 53A and 53B which are movable in the X direction. The holding block 53A has a V-shaped notch 53A' for holding a multiconductor cable therein when both the holding blocks are brought closer to each other.

A receiver block 54 is provided behind the base section 51 on the movable base 50. The receiver block 54 has three receiver slots 55 in the Y direction, three receiving channel 56 beside the receiving slots 55, and three escapement recesses 57 in the X direction.

In operation, a multiconductor cable is held by the cable holder 53, and respective conductors are placed in the receiver slots 55 such that the respective conductors are not entangled. Then, the conductors in each receiver slot are picked up one by one by the grippers in the same way as in the above embodiment and pushed into the corresponding channels of a connector half C3 while the conductors are held by the conductor guides 52 on opposite sides of the connector half C3.

The number of receiver slots 55 in this embodiment is greater than that of the above embodiment so that the number of conductors in each receiver slot is less than that of the above embodiment. As a result, the load on the pusher strip (not shown) within the receiver slot 55 is reduced. The conductor guides 52 hold each conductor in place on opposite sides of the connector half, thereby minimizing falling off of the conductor out of the retention channel due to the twisting of the conductor.

As has been described above, a conductor is brought to the desired retention channel by the grippers for insertion so that the operation becomes more reliable than ever before. Also, it is possible to separate and connect conductors to a few connector halves at the same time.

The conductor stabilizer prevents conductors from falling from the receiver slot, thereby eliminating a cause for a malfunction of the grippers. The conductor guide provides a straight portion to the conductor so that the subsequent operation is made very easy, thus increasing the dependability and efficiency of the operation.

We claim:

1. Apparatus for loading respective conductors of a multiconductor cable on retention channels of a connector half, which comprises:

(a) a connector holder for holding a connector half so that retention channels of said connector half are exposed;

(b) a cable holder movable in a direction perpendicular to said connector holder for holding said multiconductor cable beside said connector holder;

(c) receiver means for receiving said respective conductors one upon another, said receiver means including:

a receiver slot extending downwardly from a top surface of said receiver means and having a width substantially equal to a diameter of said respective conductors for receiving said respective conductors one upon another; and a biasing member provided at a bottom of said receiver slot for biasing upwardly said respective conductors within said receiver slot;

(d) transfer means movable on said receiver means in a direction perpendicular to said receiver slot and having a transfer channel parallel to said receiver slot for receiving an uppermost conductor;

(e) conductor receiving means for receiving said uppermost conductor when said transfer means is in an advanced position, said conductor receiving means including:

a receiver channel extending in parallel to said receiver slot on said receiver means for receiving said uppermost conductor when said transfer means is in said advanced position; and an escapement slot extending in a direction perpendicular to said receiver slot and having a depth greater than said diameter of said respective conductors;

(f) carrier means for bringing said uppermost conductor from said receiver means to said connector holder, said carrier means including:

a carrier arm with an end portion pivoted to said carrier means;

a pair of grippers; one fixed at said end portion of said carrier arm and the other movable along said carrier arm and gripping said uppermost conductor and contacting with a wire of said uppermost conductor for identifying a position of said uppermost conductor on said connector half when said transfer means is in said advanced position; and a conductor pusher provided beside said fixed gripper for pushing said uppermost conductor into a retention channel of said connector half at said identified position; and (g) a conductor guide provided beside said connector holder and having guide slits at positions which corresponds to said retention channels, thereby providing a straight portion for each conductor to facilitate subsequent operation.

2. Apparatus for loading respective conductors of a multiconductor cable on retention channels of a connector half, which comprises:

(a) a connector holder for holding a connector half so that retention channels of said connector half are exposed;

(b) a cable holder movable in a direction perpendicular to said connector holder for holding said multiconductor cable beside said connector holder;

(c) receiver means for receiving said respective conductors one upon another, said means including:

a receiver slot extending downwardly from a top surface of said receiver means and having a width substantially equal to a diameter of said respective conductors for receiving said respective conductors one upon another; and a biasing member provided at a bottom of said receiver slot for biasing upwardly said respective conductors within said receiver slot;

(d) transfer means movable on said receiver means in a direction perpendicular to said receiver slot and having a transfer channel parallel to said receiver slot for receiving an uppermost conductor;

(e) conductor receiving means for receiving said uppermost conductor when said transfer means is in an advanced position, said conductor receiving means including:

a receiver channel extending in parallel to said receiver slot on said receiver means for receiving said uppermost conductor when said transfer means is in said advanced position; and an escapement slot extending in a direction perpendicular to said receiver slot and having a depth greater than said diameter of said respective conductors;

(f) carrier means for bringing said uppermost conductor from said receiver means to said connector holder, said carrier means including:

a carrier arm with an end portion pivoted to said carrier means;

a pair of grippers; one fixed at said end portion of said carrier arm and the other movable along said carrier arm and gripping said uppermost conductor and contacting with a wire of said uppermost conductor for identifying a position of said uppermost conductor on said connector half when said transfer means is in said advanced position; and a conductor pusher provided beside said fixed gripper for pushing said uppermost conductor into a retention channel of said connector half at said identified position; and (g) a cable stabilizer interlocked to said transfer means and having a front edge substantially flash with said conductor receiver slot when said transfer means is in said advanced position, thereby preventing second and subsequent conductors from falling off from said receiver slot.

* * * * *